US011136514B2

(12) United States Patent
Ahmed

(10) Patent No.: US 11,136,514 B2
(45) Date of Patent: Oct. 5, 2021

(54) PROCESS AND APPARATUS FOR RECYCLING HYDROGEN TO HYDROPROCESS BIORENEWABLE FEED

(71) Applicant: UOP LLC, Des Plaines, IL (US)

(72) Inventor: Afrin Ahmed, Gurgaon (IN)

(73) Assignee: UOP LLC, Des Plaines, IL (US)

( * ) Notice: Subject to any disclaimer, the term of this patent is extended or adjusted under 35 U.S.C. 154(b) by 1 day.

(21) Appl. No.: 16/434,308

(22) Filed: Jun. 7, 2019

(65) Prior Publication Data

US 2020/0385643 A1 Dec. 10, 2020

(51) Int. Cl.

| | |
|---|---|
| ***C10G 69/00*** | (2006.01) |
| ***C10G 69/12*** | (2006.01) |
| ***C10G 7/00*** | (2006.01) |
| ***C10G 45/60*** | (2006.01) |

(52) U.S. Cl.

CPC ..... *C10G 69/123* (2013.01); *C10G 7/003* (2013.01); *C10G 45/60* (2013.01); *C10G 2300/1055* (2013.01); *C10G 2300/4081* (2013.01)

(58) Field of Classification Search

CPC ..... C10G 69/123; C10G 7/003; C10G 45/60; C10G 2300/1055; C10G 2300/4081

See application file for complete search history.

(56) References Cited

U.S. PATENT DOCUMENTS

| | | | | |
|---|---|---|---|---|
| 7,687,049 | B2 * | 3/2010 | Lapinski | C10G 35/06 423/247 |
| 8,318,996 | B2 | 3/2012 | Murty | |
| 8,575,408 | B2 | 11/2013 | Marker et al. | |
| 9,062,258 | B2 | 6/2015 | Mayeur et al. | |
| 9,845,432 | B2 | 12/2017 | Rispoli et al. | |
| 2009/0159494 | A1 * | 6/2009 | Gautam | C10G 47/00 208/58 |
| 2009/0321311 | A1 | 12/2009 | Marker et al. | |
| 2011/0239532 | A1 * | 10/2011 | Baldiraghi | C10L 1/08 44/388 |
| 2018/0148654 | A1 * | 5/2018 | Wexler | B01J 19/245 |

FOREIGN PATENT DOCUMENTS

| | | |
|---|---|---|
| EA | 014031 B | 4/2008 |

* cited by examiner

*Primary Examiner* — Prem C Singh
*Assistant Examiner* — Brandi M Doyle
(74) *Attorney, Agent, or Firm* — Paschall & Associates, LLC; James C. Paschall

(57) ABSTRACT

The process and apparatus enables purification of a recycle hydrogen gas stream from hydroprocessing biorenewable feedstocks. The recycle gas stream is fed to a methanator reactor to hydrogenate carbon monoxide in the gas stream to water and methane. Other acid gases can be removed by scrubbing preferably upstream of the methanator. Removal of carbon monoxide omits the need for a hydrogen purge stream to avoid carbon monoxide accumulation and enables use of the hydrogen for a downstream hydroisomerization reaction.

15 Claims, 1 Drawing Sheet

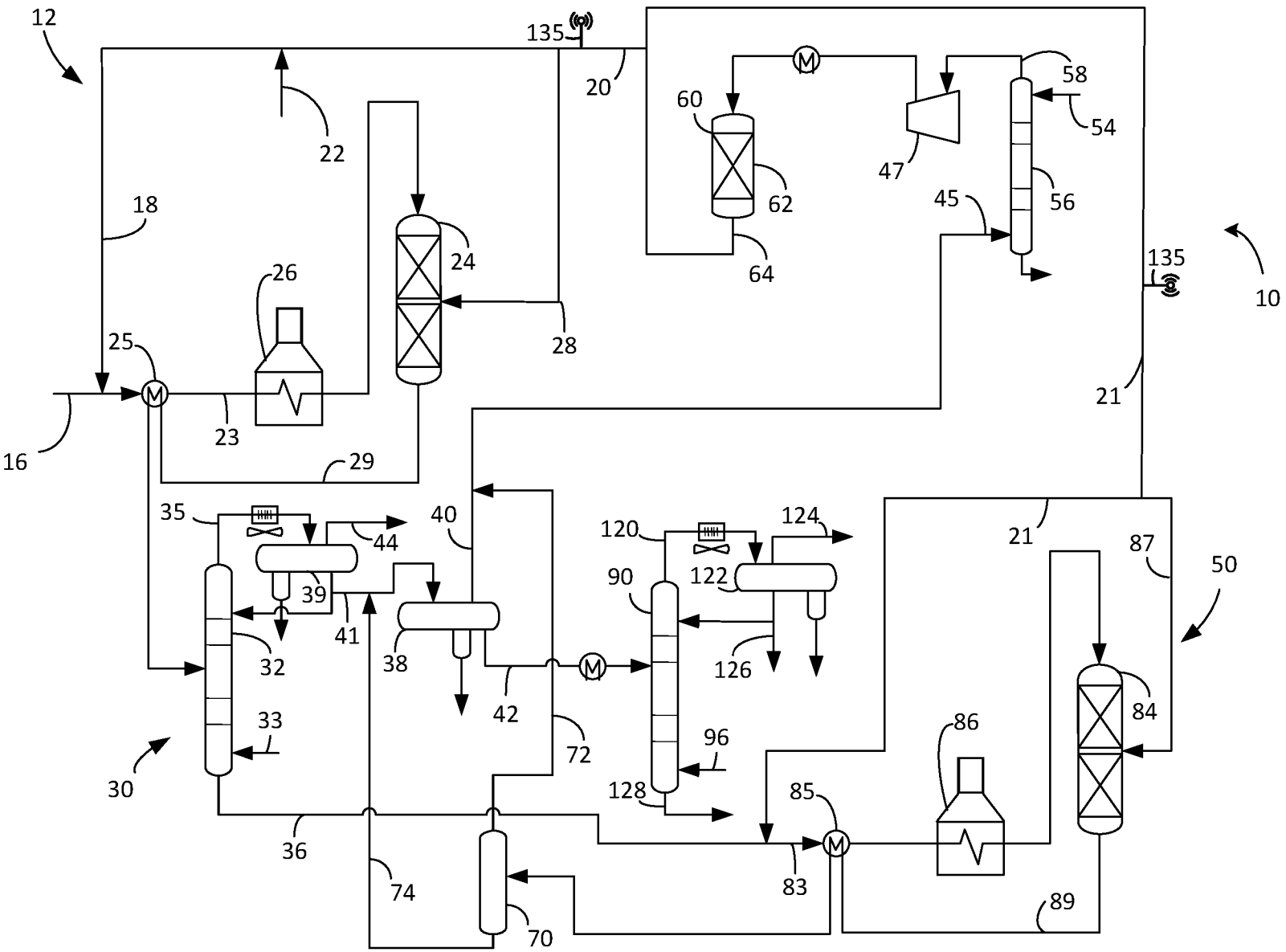
10
50
135
87
84
21
54
58
56
89
21
45
86
47
85
83
124
62
64
126
122
96
60
120
90
128
20
135
28
72
70
42
24
40
38
74
44
41
29
22
39
26
36
32
33
23
35
18
25
30
12
16

PROCESS AND APPARATUS FOR RECYCLING HYDROGEN TO HYDROPROCESS BIORENEWABLE FEED

FIELD

The field is the recovery of hydrogen from hydroprocessed stripping off gas streams.

BACKGROUND

As the demand for fuel increases worldwide, there is increasing interest in producing fuels and blending components from sources other than crude oil. Often referred to as a biorenewable source, these sources include, but are not limited to, plant oils such as corn, rapeseed, canola, soybean, microbial oils such as algal oils, animal fats such as inedible tallow, fish oils and various waste streams such as yellow and brown greases and sewage sludge. A common feature of these sources is that they are composed of glycerides and free fatty acids (FFA). Both glycerides and the FFAs contain aliphatic carbon chains having from about 8 to about 24 carbon atoms. The aliphatic carbon chains in glycerides or FFAs can be fully saturated, or mono, di or poly-unsaturated.

Hydroprocessing can include processes which convert hydrocarbons in the presence of hydroprocessing catalyst and hydrogen to more valuable products. Hydrotreating is a process in which hydrogen is contacted with hydrocarbons in the presence of hydrotreating catalysts which are primarily active for the removal of heteroatoms, such as sulfur, nitrogen, oxygen and metals from the hydrocarbon feedstock. In hydrotreating, hydrocarbons with double and triple bonds such as olefins may be saturated. Hydrotreating can be performed at high or low pressures but is typically operated at lower pressure than hydrocracking. Hydrocracking is a hydroprocessing process in which hydrocarbons crack in the presence of hydrogen and hydrocracking catalyst to lower molecular weight hydrocarbons. Hydroisomerization or hydrodewaxing is a hydroprocessing process that increases the alkyl branching on a hydrocarbon backbone in the presence of hydrogen and hydroisomerization catalyst to improve cold flow properties of the hydrocarbon. Hydroisomerization includes hydrodewaxing herein.

Diesel fuel streams must meet cold flow property specifications particularly for winter fuel use. If co-processing bio-renewable feedstock in a distillate hydrotreating unit along with mineral feedstock, there is a challenge of meeting the cold flow property requirements of the finished product diesel because the diesel range product converted from bio-renewable feedstock consists largely of normal paraffins.

The production of hydrocarbon products in the diesel boiling range can be achieved by hydrotreating a biorenewable feedstock. The biorenewable feedstock may be mixed with a mineral feedstock. A biorenewable feedstock can be hydroprocessed by hydrotreating followed by hydroisomerization to improve cold flow properties of product diesel. The hydrotreating of biorenewable feedstock results in production of $CO_2$ and CO in the hydrotreated effluent. Carbon dioxide may be removed in an amine recycle gas scrubber. However, carbon monoxide concentration can only be reduced by purging. Carbon monoxide is poisonous to hydrotreating catalyst. Hence, a large purge portion of the recycle gas stream must be purged to prevent the concentration of carbon monoxide from having a deactivating effect on the hydrotreating catalyst.

Hydroisomerization or hydrodewaxing catalyst is more sensitive than hydrotreating catalyst to carbon monoxide. Since carbon monoxide rapidly inhibits the activity of hydrodewaxing or hydroisomerization catalyst, hydrodewaxing or hydroisomerization catalyst cannot be loaded in a hydrotreating or hydrocracking reactor and hydrogen recycle streams from hydroprocessing biorenewable feeds cannot be recycled to hydroisomerization or hydrodewaxing reactors without rapid deactivation of catalyst even after amine recycle gas scrubbing.

There is a continuing need, therefore, for improved methods of purifying and recycling hydrogen from hydroprocessed biorenewable effluent streams.

BRIEF SUMMARY

The process and apparatus described herein enable purification of a recycle hydrogen gas stream from hydroprocessing biorenewable feedstocks. The recycle gas stream is fed to a methanator reactor to hydrogenate carbon monoxide in the gas stream to water and methane. Other acid gases can be removed by scrubbing preferably upstream of the methanator. Removal of carbon monoxide omits the need for a hydrogen purge stream to avoid carbon monoxide accumulation and enables use of the hydrogen for a downstream hydroisomerization reaction.

BRIEF DESCRIPTION OF THE DRAWINGS

The FIGURE is a simplified process flow diagram.

DEFINITIONS

The term "communication" means that fluid flow is operatively permitted between enumerated components, which may be characterized as "fluid communication". The term "communication" may also mean that data or signals are transmitted between enumerated components which may be characterized as "informational communication".

The term "downstream communication" means that at least a portion of fluid flowing to the subject in downstream communication may operatively flow from the object with which it fluidly communicates.

The term "upstream communication" means that at least a portion of the fluid flowing from the subject in upstream communication may operatively flow to the object with which it fluidly communicates.

The term "direct communication" means that fluid flow from the upstream component enters the downstream component without passing through any other intervening vessel.

The term "indirect communication" means that fluid flow from the upstream component enters the downstream component after passing through an intervening vessel.

The term "bypass" means that the object is out of downstream communication with a bypassing subject at least to the extent of bypassing.

As used herein, the term "a component-rich stream" means that the rich stream coming out of a vessel has a greater concentration of the component than the feed to the vessel.

As used herein, the term "a component-lean stream" means that the lean stream coming out of a vessel has a smaller concentration of the component than the feed to the vessel.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Absorber and scrubbing columns do not include a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of any reflux or reboil to the column. Stripping columns may omit a reboiler at a bottom of the column and instead provide heating requirements and separation impetus from a fluidized inert media such as steam.

As used herein, the term "True Boiling Point" (TBP) means a test method for determining the boiling point of a material which corresponds to ASTM D-2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "initial boiling point" (IBP) means the temperature at which the sample begins to boil using ASTM D-86.

As used herein, the term "T5" or "T95" means the temperature at which 5 volume percent or 95 volume percent, as the case may be, respectively, of the sample boils using ASTM D-86.

As used herein, the term "diesel cut point" is between about 343° C. (650° F.) and about 399° C. (750° F.) using the TBP distillation method.

As used herein, the term "diesel boiling range" means hydrocarbons boiling with an IBP in the range of between about 132° C. (270° F.) and about 210° C. (410° F.) and the diesel cut point using the TBP distillation method.

As used herein, the term "diesel conversion" means conversion of feed to material that boils at or below the diesel cut point of the diesel boiling range.

As used herein, the term "kerosene boiling range" means hydrocarbons boiling with an IBP in the range of between about 120° C. (248° F.) and about 150° C. (302° F.) and a kerosene cut point in the range of between about 132° C. (270° F.) and about 260° C. (500° F.) using the TBP distillation method.

As used herein, "vacuum gas oil" means a hydrocarbon material having an IBP of at least about 232° C. (450° F.), a T5 of between about 288° C. (550° F.) and about 392° C. (700° F.), typically no more than about 343° C. (650° F.), a T95 between about 510° C. (950° F.) and about 570° C. (1058° F.) and, or an EP of no more than about 626° C. (1158° F.) prepared by vacuum fractionation of atmospheric as determined by any standard gas chromatographic simulated distillation method such as ASTM D2887, D6352 or D7169, all of which are used by the petroleum industry.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator which latter may be operated at higher pressure.

As used herein, the term "predominant" or "predominate" means greater than 50%, suitably greater than 75% and preferably greater than 90%.

DETAILED DESCRIPTION

I have discovered a process and apparatus that enables biorenewable feedstock to be blended with a mineral feedstock to be processed into a diesel stream with a recycle hydroprocessed hydrogen gas that is purified of carbon monoxide. Hydroprocessed biorenewable feedstock contains substantial quantities of carbon monoxide that must be purged to avoid build-up to concentrations that can rapidly deactivate downstream hydroprocessing catalyst. Methanation of the carbon monoxide in the recycle hydrogen gas stream converts the carbon monoxide to water and methane.

As shown in the FIGURE, in accordance with an exemplary embodiment, the apparatus and process 10 for hydroprocessing hydrocarbons comprise a hydroprocessing unit 12, a separation section 30 and a hydroisomerization unit 50. A hydrocarbon feed stream in hydrocarbon line 16 and a hydrogen stream in the hydroprocessing hydrogen line 18 are fed to the hydroprocessing unit 12. Hydroprocessing effluent is separated in the separation section 30 and hydroisomerized in the hydroisomerization unit 50.

The hydrocarbon feed stream may comprise a biorenewable feedstock. In an aspect, the hydrocarbon feed stream may comprise a blend of biorenewable feedstock and mineral feedstock. The hydrocarbon feed stream may comprise about 0.5 to about 100 wt % biorenewable feedstock; typically about 1 to about 40 wt % biorenewable feedstock, suitably about 2 to about 30 wt % biorenewable feedstock and preferably about 3 to about 10 wt % biorenewable feedstock. The rest of the hydrocarbon feed steam may be a mineral feedstock. A mineral feedstock is a conventional hydrocarbon feedstock derived from crude oil that is extracted from the ground. A hydrocarbon stream derived from crude oil boiling in the diesel boiling range or a vacuum gas oil range is a suitable mineral feed stock. The mineral feedstock may comprise 0.2 to 3 wt % sulfur and 10 to 500 wppm nitrogen.

A variety of different biorenewable feedstocks may be suitable for the process and apparatus 10. The term "biorenewable feedstock" is meant to include feedstocks other than those obtained from crude oil. The biorenewable feedstock may include any of those feedstocks which comprise at least one of glycerides and free fatty acids (FFA). Most of glycerides will be triglycerides, but monoglycerides and diglycerides may be present and processed as well. Examples of these biorenewable feedstocks include, but are not limited to, camelina oil, canola oil, corn oil, soy oil, rapeseed oil, soybean oil, colza oil, tall oil, sunflower oil, hempseed oil, olive oil, linseed oil, coconut oil, castor oil, peanut oil, palm oil, mustard oil, tallow, yellow and brown greases, lard, train oil, fats in milk, fish oil, algal oil, sewage sludge, and the like. Additional examples of renewable feedstocks include non-edible vegetable oils from the group comprising *Jatropha curcas* (Ratanjot, Wild Castor, Jangli Erandi), *Madhuca indica* (Mohuwa), *Pongamia pinnata* (Karanji, Honge), *Calophyllum inophyllum, Moringa oleifera* and *Azadirachta indica* (Neem). The glycerides and FFAs of the typical vegetable or animal fat contain aliphatic hydrocarbon chains in their structure which have about 8 to about 30 carbon atoms. As will be appreciated, the biorenewable feedstock may comprise a mixture of one or more of the foregoing examples. The biorenewable feedstock may be pretreated to remove contaminants, such as in a guard bed reactor, and filtered to remove solids.

Illustrative mineral feedstocks include hydrocarbonaceous streams having initial boiling points (IBP) above about 288° C. (550° F.), such as atmospheric gas oils, vacuum gas oil (VGO) having T5 and T95 between about 315° C. (600° F.) and about 600° C. (1100° F.), deasphalted oil, coker distillates, straight run distillates, pyrolysis-derived oils, high boiling synthetic oils, cycle oils, hydrocracked feeds, catalytic cracker distillates, atmospheric residue having an IBP at or above about 343° C. (650° F.) and vacuum residue having an IBP above about 510° C. (950° F.). Preferred mineral feedstocks include hydrocarbon feeds boiling in the diesel boiling range and in the kerosene boiling range obtained from crude oil.

The hydrocarbon feed stream in feed line 16 mixes with a purified recycle hydrogen stream in a hydroprocessing hydrogen line 18. A recycle hydrogen stream in recycle hydrogen line 20 may be supplemented by a make-up hydrogen stream from line 22 to provide the hydrogen stream in the hydroprocessing hydrogen line 18. The hydrocarbon feed stream 16 may be mixed with the hydroprocessing hydrogen stream and together heated in a feed exchanger 25. The combined feed stream in a combined feed line 23 may be heated in a heater 26 where additional heat is provided before entering a hydroprocessing reactor 24. The hydrocarbon feed stream is hydroprocessed in the hydroprocessing reactor 24.

The hydroprocessing reactor 24 may be a fixed bed reactor that comprises one or more vessels, single or multiple beds of catalyst in each vessel and various combinations of hydrotreating catalyst and/or hydrocracking catalyst in one or more vessels.

In the hydroprocessing reactor 24, the combined feed 23 is contacted with a hydrotreating catalyst in the presence of the hydroprocessing hydrogen stream at hydrotreating conditions to saturate the olefinic or unsaturated portions of the n-paraffinic chains in the biorenewable feedstock. The hydrotreating catalyst also catalyzes hydrodeoxygenation including decarboxylation to remove oxygenate functional groups from the biorenewable feedstock which are converted to water and carbon oxides. The hydrotreating catalyst also catalyzes desulfurization of organic sulfur in the mineral feedstock and denitrogenation or organic nitrogen in both the mineral and biorenewable feedstock. Essentially, the hydrotreating reaction removes heteroatoms from the hydrocarbons and saturates olefins in the feed stream. Hydrocracking reactions may also occur in the hydroprocessing reactor 24.

The hydrotreating catalyst may be provided in one, two or more beds and employ interbed hydrogen quench from a quench hydrogen stream in a quench line 28.

Suitable hydrotreating catalysts are any known conventional hydrotreating catalysts and include those which are comprised of at least one Group VIII metal, preferably iron, cobalt and nickel, more preferably cobalt and/or nickel and at least one Group VI metal. The hydrotreating catalyst may comprise nickel, nickel/molybdenum, or cobalt/molybdenum dispersed on a high surface area support, such as alumina. Other suitable hydrotreating catalysts include zeolitic catalysts, as well as noble metal catalysts where the noble metal is selected from palladium and platinum dispersed on an alumina support such as gamma-alumina. It is within the scope of the present description that more than one type of hydrotreating catalyst be used in the same hydrotreating reactor 24. The Group VIII metal is typically present in an amount ranging from about 2 to about 20 wt %, preferably from about 4 to about 12 wt %. The Group VI metal will typically be present in an amount ranging from about 1 to about 25 wt %, preferably from about 2 to about 25 wt %.

Preferred hydrotreating reaction conditions include a temperature of about 40 to about 700° C., typically from about 290° C. (550° F.) to about 455° C. (850° F.), suitably 316° C. (600° F.) to about 427° C. (800° F.) and preferably 343° C. (650° F.) to about 399° C. (750° F.), a pressure of about 700 kPa (100 psig) to about 21 MPa (3000 psig), typically, from about 2.1 MPa (gauge) (300 psig), preferably from about 4.1 MPa (gauge) (600 psig) to about 11.0 MPa (gauge) (1600 psig), and preferably no more than 6.9 MPa (gauge) (1000 psig), a liquid hourly space velocity of the fresh hydrocarbon feedstock from about 0.1 $hr^{-1}$, suitably 0.5 $hr^{-1}$, to about 5 $hr^{-1}$, preferably from about 1.5 to about 4 $hr^{-1}$, and a hydrogen rate of about 84 $Nm^3/m^3$ (500 scf/bbl), to about 1,011 $Nm^3/m^3$ oil (6,000 scf/bbl), preferably about 168 $Nm^3/m^3$ oil (1,000 scf/bbl) to about 674 $Nm^3/m^3$ oil (4,000 scf/bbl), with a hydrotreating catalyst or a combination of hydrotreating catalysts.

A hydroprocessed stream is produced in a hydroprocessed effluent line 29 from the hydroprocessing reactor 24 comprising a liquid portion and a gaseous portion. The liquid portion comprises a hydrocarbon fraction which has a substantial n-paraffin concentration due to the biorenewable feedstock. Oxygenate concentration in the hydrocarbon fraction is essentially nil, whereas the olefin concentration is substantially reduced relative to the feed stream. The organic sulfur concentration in the hydrocarbon fraction may be no more than about 500 wppm and the organic nitrogen concentration in the hydrocarbon fraction may be no more than about 10 wppm.

The hydroprocessing reactor 24 provides a hydroprocessing effluent stream that exits the hydroprocessing reactor 24 in a hydroprocessing effluent line 29. The hydroprocessed stream comprises material that will be separated in a separation section 30 comprising one or more separators into a liquid hydroprocessed stream and a gaseous hydroprocessed stream. The separation section 30 is in downstream communication with the hydroprocessing reactor 24.

The hydroprocessed stream in hydroprocessing effluent line 29 may in an aspect be heat exchanged in the combined feed exchanger 25 with the hydrocarbon feed stream in line 16 to be cooled. The hydroprocessed stream in the hydroprocessed effluent line 29 provides heat to the hydroprocessing feed as previously described to cool the hydroprocessed stream in the hydroprocessed effluent line 29.

The separation section 30 separates the hydroprocessed stream in the hydroprocessed effluent line 29 to provide a gaseous stream comprising hydrogen and carbon monoxide and a liquid hydroprocessed stream. The separations section 30 may include a hydroprocessing stripping column 32 that separates the gaseous stream from the liquid hydroprocessed stream. The hydroprocessing stripping column 32 may be in downstream communication with the hydroprocessing reactor 24. The hydroprocessed stream may be cooled and fed to the hydroprocessing stripping column 32. The hydroprocessed stream may be stripped of light gases in the hydroprocessing stripping column 32 with a stripping media which is an inert gas such as steam from a stripping media line 33 to provide a stripping overhead gaseous stream of hydrogen, hydrogen sulfide, stripping media, methane, ethane and propane and other gases in a stripping overhead line 35. The methane comprises methanator effluent from a methanator reactor 62 that is inert in the hydroprocessing reactor 24 as will be described hereinafter. Ethane and propane are produced in the deoxygenation and decarboxylation reactions in the hydroprocessing reactor 24. Alternatively, the hydroprocessing stripping column 32 may use a reboiler which may be a fired heater and omit the stripping media line 33 but this embodiment is not shown. The hydroprocessing stripping column 32 strips light gases from the hydroprocessed stream to separate the stripping overhead gaseous stream in a hydroprocessed stripping overhead line 35 from a stripped liquid hydroprocessed stream in a hydroprocessed stripped bottoms line 36.

The stripping overhead gaseous stream in the hydroprocessed stripping overhead line 35 may be condensed by cooling and separated in a hydroprocessing receiver 39. A hydroprocessed net stripping overhead line 44 from the hydroprocessing receiver 39 carries a net stripping overhead gaseous stream for further treating. The net stripping overhead gaseous stream comprises methane produced in the methanator reactor 60 and other gases, hydrogen, hydrogen sulfide, stripping media, ethane and propane. The hydroprocessed net stripping overhead line 44 removes methane produced in the methanator 60 from the process and apparatus 10 along with hydrogen and the other gases. A hydroprocessed overhead liquid stream in a receiver bottoms line from a bottom of the hydroprocessing receiver 39 may be split between a reflux stream in reflux line which is returned to the hydroprocessing stripping column 32 and a net hydroprocessed overhead liquid stream in a hydroprocessed overhead liquid line 41 comprising unstabilized naphtha. The net hydroprocessed overhead liquid stream in the hydroprocessed overhead liquid line 41 may be mixed with an hydroisomerization liquid stream in an hydroisomerization bottoms line 74 and fed to a cold separator 38. A sour water stream may be collected from a boot of the hydroprocessing receiver 39.

The hydroprocessing stripping column 32 may be operated with a bottoms temperature between about 160° C. (320° F.) and about 360° C. (680° F.), and an overhead pressure of about 0.35 MPa (gauge) (50 psig), preferably about 0.70 MPa (gauge) (100 psig), to about 2.0 MPa (gauge) (300 psig). The temperature in the hydroprocessing overhead receiver 39 ranges from about 38° C. (100° F.) to about 66° C. (150° F.) and the pressure is essentially the same as in the overhead of the hydroprocessing stripping column 32.

The hydroprocessing stripping column 32 separates a stripped liquid hydroprocessed stream from the hydroprocessed stream in a hydroprocessing stripping bottoms line 36. The stripped liquid hydroprocessed stream in a hydroprocessed stripped bottoms line 36 may be hydroisomerized in the hydroisomerization unit 50. The hydroprocessing stripping column 32 may be in downstream communication with the hydroprocessing reactor 24.

In the embodiment of the FIGURE, the stripped liquid hydroprocessed stream in the hydroprocessed stripped bottoms line 36 comprises diesel boiling range material including green diesel or biodiesel. Although this hydrocarbon fraction is useful as a diesel fuel, because it comprises a substantial concentration of n-paraffins from the biorenewable feedstock, it will have poor cold flow properties. The liquid hydroprocessed stream can be contacted with a hydroisomerization catalyst under hydroisomerization conditions to at least partially hydroisomerize the n-paraffins to isoparaffins, as hereinafter described in a separate hydroisomerization reactor 84.

The combined stripped stream may be hydroisomerized over hydroisomerization catalyst in the presence of a hydroisomerization hydrogen stream. Methanated recycle hydroisomerization hydrogen gas in the hydroisomerization hydrogen line 21 may be added to the stripped liquid hydroprocessed stream in the hydroprocessed stripped bottoms line 36 to provide a combined hydroisomerization feed stream in a hydroisomerization feed line 83. The combined hydroisomerization feed stream in the hydroisomerization feed line 83 may be heated in a combined hydroisomerization feed exchanger 85 by heat exchange with the hydroisomerized stream in the hydroisomerized effluent line 89 and heated in a hydroisomerization charge heater 86 to bring the combined hydroisomerization feed stream to hydroisomerization temperature before charging the hydroisomerization reactor 84.

The hydroisomerization, including hydrodewaxing, of the normal hydrocarbons in the hydroisomerization reactor 84 can be accomplished in the presence of the hydroisomerization hydrogen stream over one or more beds of hydroisomerization catalyst, and the hydroisomerization may be operated in a co-current mode of operation. Fixed bed, trickle bed down-flow or fixed bed liquid filled up-flow modes are both suitable. A hydrogen quench stream in hydroisomerization quench lien 87 taken from the hydroisomerization hydrogen gas in the hydroisomerization hydrogen line 21 may be provided for interbed quench to the hydroisomerization reactor 84. The hydroisomerization reactor 84 is in downstream communication with the methanator reactor 60 via the hydroisomerization hydrogen line 21.

Suitable hydroisomerization catalysts may comprise a metal of Group VIII (IUPAC 8-10) of the Periodic Table and a support material. Suitable Group VIII metals include platinum and palladium, each of which may be used alone or in combination. The support material may be amorphous or crystalline. Suitable support materials include amorphous alumina, amorphous silica-alumina, ferrierite, ALPO-31, SAPO-11, SAPO-31, SAPO-37, SAPO-41, SM-3, MgAPSO-31, FU-9, NU-10, NU-23, ZSM-12, ZSM-22, ZSM-23, ZSM-35, ZSM-48, ZSM-50, ZSM-57, MeAPO-11, MeAPO-31, MeAPO-41, MgAPSO-11, MgAPSO-31, MgAPSO-41, MgAPSO-46, ELAPO-11, ELAPO-31, ELAPO-41, ELAPSO-11, ELAPSO-31, ELAPSO-41, laumontite, cancrinite, offretite, hydrogen form of stillbite, magnesium or calcium form of mordenite, and magnesium or calcium form of partheite, each of which may be used alone or in combination. ALPO-31 is described in U.S. Pat. No. 4,310,440. SAPO-11, SAPO-31, SAPO-37, and SAPO-41 are described in U.S. Pat. No. 4,440,871. SM-3 is described in U.S. Pat. Nos. 4,943,424; 5,087,347; 5,158,665; and 5,208,005. MgAPSO is a MeAPSO, which is an acronym for a metal aluminumsilicophosphate molecular sieve, where the metal, Me, is magnesium (Mg). Suitable MgAPSO-31 catalysts include MgAPSO-31. MeAPSOs are described in U.S. Pat. No. 4,793,984, and MgAPSOs are described in U.S. Pat. No. 4,758,419. MgAPSO-31 is a preferred MgAPSO, where 31 means a MgAPSO having structure type 31. Many natural zeolites, such as ferrierite, that have an initially reduced pore size can be converted to forms suitable for olefin skeletal hydroisomerization by removing associated alkali metal or alkaline earth metal by ammonium ion exchange and calcination to produce the substantially hydrogen form, as taught in U.S. Pat. Nos. 4,795,623 and 4,924,027. Further catalysts and conditions for skeletal isomerization are disclosed in U.S. Pat. Nos. 5,510,306, 5,082,956, and 5,741,759. The hydroisomerization catalyst may also comprise a modifier selected from the group consisting of lanthanum, cerium, praseodymium, neodymium, samarium, gadolinium, terbium, and mixtures thereof, as described in U.S. Pat. Nos. 5,716,897 and 5,851,949. Other suitable support materials include ZSM-22, ZSM-23, and ZSM-35, which are described for use in dewaxing in U.S. Pat. No. 5,246,566 and in the article entitled S. J. Miller, "New Molecular Sieve Process for Lube Dewaxing by Wax Isomerization," 2 Microporous Materials 439-449 (1994). U.S. Pat. Nos. 5,444,032 and 5,608,968 teach a suitable bifunctional catalyst which is constituted by an amorphous silica-alumina gel and one or more metals belonging to Group VIIIA and is effective in the hydroisomerization of long-chain normal paraffins containing more than 15 carbon atoms. U.S. Pat. Nos. 5,981,419 and 5,908,134 teach a suitable bifunctional catalyst which comprises: (a) a porous crystalline material isostructural with beta-zeolite selected from boro-silicate (BOR-B) and boro-alumino-silicate (Al-BOR-B) in which the molar $SiO_2$:$Al_2O_3$ ratio is higher than 300:1; (b) one or more metal(s) belonging to Group VIIIA, selected from platinum and palladium, in an amount comprised within the range of from 0.05 to 5% by weight. V. Calemma et al., App. Catal. A: Gen., 190 (2000), 207 teaches yet another suitable catalyst. DI-100 available from UOP LLC in Des Plaines, Ill. may be a suitable catalyst.

Hydroisomerization conditions generally include a temperature of about 150° C. (302° F.) to about 450° C. (842° F.) and a pressure of about 1724 kPa (abs) (250 psia) to about 13.8 MPa (abs) (2000 psia). In another embodiment, the hydroisomerization conditions include a temperature of about 300° C. (572° F.) to about 360° C. (680° F.) and a pressure of about 3102 kPa (abs) (450 psia) to about 6895 kPa (abs) (1000 psia).

A hydroisomerized stream in the hydroisomerized line 89 from the hydroisomerization reactor 84 is a branched-paraffin-rich stream. By the term "rich" it is meant that the effluent stream has a greater concentration of branched paraffins than the stream entering the hydroisomerization reactor 84, and preferably comprises greater than 50 mass-% branched paraffins of the total paraffin content. It is envisioned that the hydroisomerized effluent may contain 70, 80, or 90 mass-% branched paraffins of the total paraffin content. Only minimal branching is required, enough to improve the cold-flow properties of the hydroprocessed hot liquid stream to meet specifications. Hydroisomerization conditions are selected to avoid undesirable cracking, so the predominant product in the hydroisomerized stream in the hydroisomerized line 89 is a mono-branched paraffin.

The hydroisomerized stream in the hydroisomerized line 89 from the hydroisomerization reactor 84 flows to the feed exchanger 85 to be heat exchanged with the combined hydroisomerization feed stream in a hydroisomerization feed line to cool it before entering the hydroisomerization separator 70 for separation into a liquid hydroisomerized stream and vapor hydroisomerized stream. The hydroisomerization separator 70 may be operated at a temperature of about 200 to about 280° C. and a gauge pressure of about 4500 to about 6000 kPa.

The liquid hydroisomerized stream in the hydroisomerization bottoms line 74 extending from a bottom of the hydroisomerization separator 70 which may comprise a diesel fuel may be separated in the cold separator 38. The net hydroprocessed overhead liquid stream in the hydroprocessed overhead liquid line 41 may be separated in the cold separator. The net hydroprocessed overhead liquid stream in the hydroprocessed overhead liquid line 41 may be mixed with the hydroisomerization liquid stream in the hydroisomerization bottoms line 74 and separated in the cold separator 38 together. The cold separator 38 provides a cold gaseous stream in a cold overhead line 40 and a cold liquid hydroprocessed stream in a cold bottoms line 42. The hydrogen in the cold gaseous stream is predominantly from the hydroisomerization reactor 84. The cold separator 38 serves to separate hydrogen from hydrocarbon in the net hydroprocessed overhead liquid stream in the hydroprocessed overhead liquid line 41 and the hydroisomerization liquid stream in the hydroisomerization bottoms line 74 for recycle to the hydroprocessing reactor 24 and the hydroisomerization reactor 84 in the cold overhead line 40. The cold separator 38, therefore, is in downstream communication with the overhead line 34 of the hydroprocessing stripping column 32 and the hydroprocessing reactor 24 and the hydroisomerization overhead line 72 of the hydroisomerization separator 70 and the hydroisomerization reactor 84.

The cold separator 38 may be operated at about 100° F. (38° C.) to about 150° F. (66° C.), suitably about 115° F. (46° C.) to about 145° F. (63° C.), and just below the pressure of the hydroprocessing receiver 39 accounting for the pressure drop of intervening equipment to keep hydrogen and light gases in the overhead and normally liquid hydrocarbons in the bottoms. The cold separator 38 may also have a boot for collecting an aqueous phase. The cold liquid hydroprocessed stream in the cold bottoms line 42 may have a temperature of the operating temperature of the cold separator 38.

In an aspect, the cold liquid hydroprocessed stream in the cold bottoms line 42 may be stripped as a cold hydroprocessing effluent stream in an hydroisomerization stripping column 90. In a further aspect, the cold liquid stream may be let down in pressure and flashed in a cold flash drum (not shown) to reduce the pressure of the cold liquid hydroprocessed stream in the cold bottoms line 42. A cold aqueous stream may be removed from a boot in the cold separator 38.

The vapor hydroisomerized stream in a hydroisomerized overhead line 72 extending from an overhead of hydroisomerization separator 70 is rich in hydrogen. Hence, the vapor hydroisomerized stream may be transported to a scrubber column 56. The cold gaseous stream in the cold overhead line 40 extending from a top of the cold separator may be transported to the scrubber column 56. The cold gaseous stream in the cold overhead line 40 may be mixed with the vapor hydroisomerized stream in the hydroisomerized overhead line 72 to produce a combined overhead stream that is rich in hydrogen which can be recovered. Optionally, the combined overhead stream may be transported together in combined overhead line 45 to the scrubber column 56.

The vapor hydroisomerized stream in the hydroisomerized overhead line 72 may be passed through a trayed or packed recycle scrubbing column 56 where it is scrubbed by means of a scrubbing extraction liquid such as an aqueous amine solution to remove acid gases including hydrogen sulfide and carbon dioxide by extracting them into the aqueous solution. The cold gaseous stream in the cold overhead line 40 may be passed through a trayed or packed recycle scrubbing column 56 where it is scrubbed by means of a scrubbing extraction liquid such as an aqueous amine solution to remove acid gases. The vapor hydroisomerized stream in the hydroisomerized overhead line 72 may be passed through the scrubbing column 56 separately from the cold gaseous stream in the cold overhead line 40. The scrubbing column 56 may be in downstream communication with the cold separator 38 and/or the hydroisomerization separator 70. In the recycle scrubber column 56, the cold gaseous stream and the vapor hydroisomerized stream enter the recycle scrubber column 56 at an inlet or inlets near a bottom and flows upwardly, while a lean amine stream in a solvent line 54 enters the stripping scrubber column at an inlet near a top and flows downwardly. Preferred lean amines include alkanolamines DEA, MEA, and MDEA. Other amines can be used in place of or in addition to the preferred amines.

The spent scrubbing liquid from the bottoms may be regenerated and recycled back to the recycle scrubbing column 56.

The scrubbed hydrogen-rich gaseous stream emerges from the scrubber via an overhead line 58 and may be compressed in a recycle compressor 47 to a gauge pressure of about 5100 kPa to about 5900 kPa to provide a recycle hydrogen stream in line 20. The recycle compressor 47 may be in downstream communication with the scrubbing column 56.

The scrubbed hydrogen-rich stream can be concentrated in carbon monoxide, which is not absorbed by the scrubbing extraction liquid. The amines do not absorb the carbon monoxide. To avoid accumulation of carbon monoxide in the hydrogen recycle stream in hydrogen line 20, a purge was conventionally taken from this stream when the hydrocarbon feed comprised biorenewable feedstock. Hydrogen is lost in this purge, forfeiting valuable material. A relatively large purge rate had to be taken to avoid accumulation of carbon monoxide to concentrations that would harm the hydrotreating catalyst. We propose to install a methanator reactor 60 on the hydrogen recycle line 20 to methanate the scrubbed hydrogen-rich gaseous stream over a methanating catalyst to hydrogenate carbon monoxide to water and methane to provide a methanated gaseous stream. The methane does not harm the hydrotreating catalyst in the hydroprocessing reactor 24. The methane can be bled out through the net stripping overhead gaseous stream in net hydroprocessing stripping overhead line 44.

The methanator reactor 60 may comprise a fixed bed 62 of methanating catalyst. The methanating catalyst may comprise nickel or cobalt and molybdenum on a support such as alumina. A suitable methanting catalyst is Katalco methanation catalyst from Johnson Mathey Inc. The methanator reactor 60 may be in downstream communication with the scrubbing column 56. Moreover, the methanator reactor 60 may be in downstream communication with the overhead line 40 of the cold separator 38.

The compressed, scrubbed hydrogen-rich stream from the compressor may be heated to a reaction temperature of about 120 to about 270° C. and fed to the methanator reactor 60. The methanated hydrogen effluent in methanated line 64 may be split between the hydrogen recycle stream in hydrogen line 20 and an hydroisomerization hydrogen stream in hydroisomerization hydrogen line 21.

The recycle hydrogen stream in line 20 may be supplemented with a make-up hydrogen stream 22 to provide the hydrogen stream in the hydroprocessing hydrogen line 18. A portion of the material in line 20 may be routed to the intermediate catalyst bed outlets in the hydroprocessing reactor 24 to control the inlet temperature of the subsequent catalyst bed, preferably before make-up gas is added.

The separation section 30 may include also include an hydroisomerization stripping column 90. The hydroisomerization stripping column 90 may be in downstream communication with a bottoms line in the separation section 30. For example, the hydroisomerization stripping column 90 may be in downstream communication with the hydroprocessing reactor 24, the hydroprocessed overhead liquid line 41 and the cold bottoms line 42. In an aspect, the hydroisomerization stripping column 90 may comprise two stripping columns. The hydroisomerization stripping column 90 may be in downstream communication with the cold bottoms line 42 for stripping the cold hydroprocessing liquid stream. The hydroisomerization stripping column 90 may be in downstream communication with the hydroprocessed overhead liquid line 41 for stripping the net hydroprocessed overhead liquid stream. The hydroisomerization stripping column 90 may be in downstream communication with the hydroisomerized liquid stream in the hydroisomerization bottoms line 74 for stripping the hydroisomerized liquid stream.

The cold hydroprocessing liquid stream in the cold bottoms line 42 may be heated and fed to the hydroisomerization stripping column 90 at a location that may be in the top half of the hydroisomerization stripping column 90. The cold hydroprocessing effluent stream comprising at least a portion of the hydroprocessed stream and the hydroisomerized stream may be stripped of light gases in the hydroisomerization stripping column 90 with a stripping media which is an inert gas such as steam from a stripping media line 96 to provide an overhead vapor stream of naphtha, hydrogen, hydrogen sulfide, steam, methane and other gases in a stripping overhead line 120. The methane comprises methanator effluent from the methanator reactor 60 which is inert in the hydroisomerization reactor 84. Alternatively, the hydroisomerization stripping column 90 may use a reboiler which may be a fired heater and omit the stripping media line 96 but this embodiment is not shown. The hydroisomerization stripping column 90 strips light gases from the cold liquid stream to provide an hydroisomerized stripping overhead stream in a hydroisomerization stripping overhead line 120 and a stripped hydroisomerized stream in an hydroisomerized stripped bottoms line 128.

At least a portion of the hydroisomerized stripping overhead stream may be condensed and separated in an hydroisomerization receiver 122. A net stripping overhead line 124 from the receiver 122 carries a net stripping vapor stream for further treating. The net stripping overhead vapor stream comprises methane produced in the methanator reactor that is removed from the process and apparatus 10. The stripping column 90 may be run at total reflux, so all condensed material may be refluxed to the column. Alternatively, unstabilized liquid naphtha from the bottoms of the receiver 122 may be split between a reflux portion refluxed to the top of the hydroisomerization stripping column 90 and a stripping overhead liquid stream in a stripping overhead liquid line 126 which may be recovered or further processed. A sour water stream (not shown) may be collected from a boot of the overhead receiver 122.

The hydroisomerization stripping column 90 may be operated with a bottoms temperature between about 160° C. (320° F.) and about 360° C. (680° F.), and an overhead pressure of about 0.35 MPa (gauge) (50 psig), preferably about 0.70 MPa (gauge) (100 psig), to about 2.0 MPa (gauge) (300 psig). The temperature in the overhead receiver 122 ranges from about 38° C. (100° F.) to about 66° C. (150° F.) and the pressure is essentially the same as in the overhead of the hydroisomerization stripping column 90.

When the feed stream to the hydroprocessing reactor 24 is in the diesel boiling range, the hydroisomerized stripped stream in the hydroisomerization stripped line 128 comprises predominantly diesel range boiling material. Consequently, the hydroisomerized stripped stream in the hydroisomerization stripped line 128 may be transported to a diesel blending pool and stored. When the feed stream to the hydroprocessing reactor 24 is in the kerosene boiling range, a hydroisomerized stripped stream in the hydroisomerization stripped line 128 comprises predominantly kerosene range boiling material. Consequently, the hydroisomerized stripped stream in the hydroisomerization stripped line 130 could be transported to a kerosene blending pool and stored. If the feed stream to the hydroprocessing reactor 24 is a heavier stream such as a gas oil, the hydroisomerized stripped stream in the hydroisomerization stripped line 128 may be fed to a product fractionation column that is not shown for recovery of naphtha, kerosene, diesel and unconverted oil streams.

Network devices 135 can comprise sensors in communication with various streams in lines in FIG. 1 for determining compositions and/or conditions of the stream therein and a transmitter for transmitting a signal or data constituting the measurement to an appropriate receiver. The network devices 135 may be in direct communication, indirect communication, upstream communication and/or downstream communication with the streams in the lines in FIG. 1. The network device 135 may be in a line transporting a stream derived from or fed to a vessel in FIG. 1. Network devices 135 with sensors and transmitters may be provided on a product line from the methanator reactor 60 such as hydroisomerization hydrogen line 21 or hydrogen line 20 to measure a composition, such as a carbon monoxide concentration, and/or condition of a stream therein and transmit a signal constituting the measurement to an appropriate receiver. The sensor may include a temperature gauge, a pressure gauge, a molecular weight analyzer, a specific gravity analyzer, a flow meter, a gas chromatograph, an x-ray diffractometer or any other such sensing or measuring device.

Specific Embodiments

While the following is described in conjunction with specific embodiments, it will be understood that this description is intended to illustrate and not limit the scope of the preceding description and the appended claims.

A first embodiment of the disclosure is a process comprising providing a hydrocarbon feed stream comprising a biorenewable feedstock; hydroprocessing the hydrocarbon feed stream in a hydroprocessing reactor in the presence of a hydrogen stream to provide a hydroprocessed stream; separating the hydroprocessed stream to provide a gaseous stream comprising hydrogen and carbon monoxide and a liquid hydroprocessed stream; methanating the gaseous stream over a methanating catalyst to hydrogenate carbon monoxide to water and methane to provide a methanated gaseous stream; and providing the hydrogen stream from the methanated gaseous stream. An embodiment of the disclosure is one, any or all of prior embodiments in this paragraph up through the first embodiment in this paragraph further comprising scrubbing acid gases from the gaseous stream. An embodiment of the disclosure is one, any or all of prior embodiments in this paragraph up through the first embodiment in this paragraph further comprising compressing the gaseous stream. An embodiment of the disclosure is one, any or all of prior embodiments in this paragraph up through the first embodiment in this paragraph where the hydrocarbon feed stream comprises at least 5 wt % biorenewable feedstock. An embodiment of the disclosure is one, any or all of prior embodiments in this paragraph up through the first embodiment in this paragraph wherein the separation step incudes stripping light gases from the hydroprocessed stream to provide a stripping overhead gaseous stream and a stripped liquid hydroprocessed stream. An embodiment of the disclosure is one, any or all of prior embodiments in this paragraph up through the first embodiment in this paragraph further comprising removing methane from the process in the stripping overhead gaseous stream. An embodiment of the disclosure is one, any or all of prior embodiments in this paragraph up through the first embodiment in this paragraph further comprising hydroisomerizing the stripped liquid hydroprocessed stream to provide a hydroisomerized stream. An embodiment of the disclosure is one, any or all of prior embodiments in this paragraph up through the first embodiment in this paragraph further comprising separating the hydroisomerized stream and stripping gases from a liquid hydroisomerized stream. An embodiment of the disclosure is one, any or all of prior embodiments in this paragraph up through the first embodiment in this paragraph further comprising condensing the stripping overhead gaseous stream to provide a net hydroprocessed overhead liquid stream and separating the net hydroprocessed overhead liquid stream and the liquid hydroisomerized stream to provide a cold liquid hydroprocessed stream and stripping light gases from the cold liquid hydroprocessed stream. An embodiment of the disclosure is one, any or all of prior embodiments in this paragraph up through the first embodiment in this paragraph further comprising hydroisomerizing the liquid hydroprocessed stream. An embodiment of the disclosure is one, any or all of prior embodiments in this paragraph up through the first embodiment in this paragraph further comprising recycling the methanated gaseous stream to a hydroisomerization reactor and hydroisomerizing the liquid hydroprocessed stream in the hydroisomerization reactor. An embodiment of the disclosure is one, any or all of prior embodiments in this paragraph up through the first embodiment in this paragraph wherein the methanating catalyst comprises nickel or cobalt and molybdenum. An embodiment of the disclosure is one, any or all of prior embodiments in this paragraph up through the first embodiment in this paragraph, further comprising at least one of sensing at least one parameter of the process and generating or transmitting a signal or data from the sensing.

A second embodiment of the disclosure is a process comprising providing a hydrocarbon feed stream comprising a biorenewable feedstock; hydroprocessing the hydrocarbon feed stream in the presence of a hydrogen stream in a hydroprocessing reactor to provide a hydroprocessed stream; separating the hydroprocessed stream to provide a gaseous stream comprising hydrogen and carbon monoxide and a liquid hydroprocessed stream; scrubbing acid gases from the gaseous stream to provide a scrubbed gaseous stream; compressing the scrubbed gaseous stream to provide a compressed, scrubbed gaseous stream; methanating the gaseous stream over a methanating catalyst to hydrogenate carbon monoxide to water and methane to provide a methanated gaseous stream; and providing the hydrogen stream from the methanated gaseous stream. An embodiment of the disclosure is one, any or all of prior embodiments in this paragraph up through the second embodiment in this paragraph further comprising adding make-up hydrogen gas to the methanated gaseous stream. An embodiment of the disclosure is one, any or all of prior embodiments in this paragraph up through the second embodiment in this paragraph further comprising taking a quench gas stream from the scrubbed, compressed gaseous stream and feeding the quench gas stream to interbed locations in a hydroprocessing reactor in which the hydroprocessing step is performed. An embodiment of the disclosure is one, any or all of prior embodiments in this paragraph up through the second embodiment in this paragraph further stripping light gases from the hydroprocessed stream to provide a stripping overhead stream and a stripped hydroprocessed stream comprising diesel. An embodiment of the disclosure is one, any or all of prior embodiments in this paragraph up through the second embodiment in this paragraph further comprising stripping the hydroprocessed stream to provide a hot gaseous stream and the hydroprocessed liquid stream and separating the hot gaseous stream in a cold separator to provide the gaseous stream and a cold liquid hydroprocessed stream and stripping light gases from the cold liquid hydroprocessed stream to provide a stripping overhead stream and a stripped hydroprocessed stream comprising diesel.

A third embodiment of the disclosure is an apparatus comprising a hydroprocessing reactor; a separator in downstream communication with the hydroprocessing reactor; an overhead line extending from an overhead of the separator; a methanator reactor in downstream communication with the overhead line; and the hydroprocessing reactor being in downstream communication with the methanator reactor. An embodiment of the disclosure is one, any or all of prior embodiments in this paragraph up through the third embodiment in this paragraph further comprising a scrubbing column in downstream communication with the separator and the methanator reactor is in downstream communication with the scrubbing column. An embodiment of the disclosure is one, any or all of prior embodiments in this paragraph up through the third embodiment in this paragraph further comprising a compressor in downstream communication with the scrubbing column, the methanator reactor being in downstream communication with the scrubbing column and a hydroisomerization reactor in downstream communication with the methanator reactor.

Without further elaboration, it is believed that using the preceding description that one skilled in the art can utilize the present disclosure to its fullest extent and easily ascertain the essential characteristics of this disclosure, without departing from the spirit and scope thereof, to make various changes and modifications of the disclosure and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A hydroprocessing process comprising:

providing a hydrocarbon feed stream comprising a biorenewable feedstock;

hydroprocessing said hydrocarbon feed stream in a hydroprocessing reactor in the presence of a hydrogen stream to provide a hydroprocessed stream;

stripping light gases from said hydroprocessed stream to provide a stripping overhead gaseous stream and a stripped liquid hydroprocessed stream;

separating said stripping overhead gaseous stream to provide a net stripping overhead gaseous stream and a net hydroprocessed overhead liquid stream, wherein methane from the process is removed in said net stripping overhead gaseous stream;

separating said net hydroprocessed overhead liquid stream to provide a liquid hydroprocessed stream and a gaseous stream comprising hydrogen and carbon monoxide;

methanating said gaseous stream in a methanator reactor over a methanating catalyst to hydrogenate carbon monoxide to water and methane to provide a methanated gaseous stream; and providing said hydrogen stream from said methanated gaseous stream.

2. The process of claim 1 further comprising scrubbing acid gases from said gaseous stream.

3. The process of claim 1 further comprising compressing said gaseous stream.

4. The process of claim 1 where said hydrocarbon feed stream comprises at least 5 wt % biorenewable feedstock.

5. The process of claim 1 further comprising hydroisomerizing said stripped liquid hydroprocessed stream to provide a hydroisomerized stream.

6. The process of claim 5 further comprising separating said hydroisomerized stream and stripping gases from a liquid hydroisomerized stream.

7. The process of claim 6 further comprising condensing said stripping overhead gaseous stream to provide the net hydroprocessed overhead liquid stream and separating said net hydroprocessed overhead liquid stream and said liquid hydroisomerized stream to provide a cold liquid hydroprocessed stream and stripping light gases from said cold liquid hydroprocessed stream.

8. The process of claim 1 further comprising hydroisomerizing said liquid hydroprocessed stream.

9. The process of claim 1 further comprising recycling said methanated gaseous stream to a hydroisomerization reactor and hydroisomerizing said liquid hydroprocessed stream in said hydroisomerization reactor.

10. The process of claim 1 wherein the methanating catalyst comprises nickel or cobalt and molybdenum.

11. The process of claim 1, further comprising at least one of:

sensing at least one parameter of the process, and generating or transmitting a signal or data from the sensing.

12. A hydroprocessing process comprising:

providing a hydrocarbon feed stream comprising a biorenewable feedstock;

hydroprocessing said hydrocarbon feed stream in the presence of a hydrogen stream in a hydroprocessing reactor to provide a hydroprocessed stream;

stripping light gases from said hydroprocessed stream to provide a stripping overhead gaseous stream and a stripped liquid hydroprocessed stream;

separating said stripping overhead gaseous stream to provide a net stripping overhead gaseous stream and a net hydroprocessed overhead liquid stream, wherein methane from the process is removed in said net stripping overhead gaseous stream;

separating said net hydroprocessed overhead liquid stream to provide a liquid hydroprocessed stream and a gaseous stream comprising hydrogen and carbon monoxide;

scrubbing acid gases from said gaseous stream to provide a scrubbed gaseous stream;

compressing said scrubbed gaseous stream to provide a compressed, scrubbed gaseous stream;

methanating said compressed, scrubbed gaseous stream over a methanating catalyst to hydrogenate carbon monoxide to water and methane to provide a methanated gaseous stream; and providing said hydrogen stream from said methanated gaseous stream.

13. The process of claim 12 further comprising adding make-up hydrogen gas to said methanated gaseous stream.

14. The process of claim 12 further comprising taking a quench gas stream from said scrubbed, compressed gaseous stream and feeding the quench gas stream to interbed locations in a hydroprocessing reactor in which said hydroprocessing step is performed.

15. The process of claim 12 further comprising stripping said hydroprocessed stream to provide a hot gaseous stream and said hydroprocessed liquid stream and separating said hot gaseous stream in a cold separator to provide said gaseous stream and a cold liquid hydroprocessed stream and stripping light gases from said cold liquid hydroprocessed stream to provide a stripping overhead stream and a stripped hydroprocessed stream comprising diesel.

* * * * *